US005993253A

United States Patent [19]

Sai

[11] Patent Number: 5,993,253

[45] Date of Patent: Nov. 30, 1999

[54] ELECTRICAL CONNECTOR HAVING CONTACT ARMS BIASED BY AN ELASTIC MEMBER

[75] Inventor: Noriaki Sai, Yokohama, Japan

[73] Assignee: The Whitaker Corporation, Wilmington, Del.

[21] Appl. No.: 08/974,811

[22] Filed: Nov. 20, 1997

[30] Foreign Application Priority Data

Nov. 25, 1996 [JP] Japan ..... 8-329166

[51] Int. Cl.[6] ..... H01R 9/05

[52] U.S. Cl. ..... 439/578; 439/825

[58] Field of Search ..... 439/825, 592, 439/578, 675, 587, 274, 275, 583, 584, 580

[56] References Cited

U.S. PATENT DOCUMENTS

| | | | |
|---|---|---|---|
| 2,502,634 | 4/1950 | Smith | 439/592 |
| 3,634,815 | 1/1972 | Stevens | 439/583 |
| 3,639,889 | 2/1972 | Komadina | 439/675 |
| 3,932,020 | 1/1976 | Gilbert | 439/578 |
| 5,595,499 | 1/1997 | Zander | 439/825 |

FOREIGN PATENT DOCUMENTS

| | | | |
|---|---|---|---|
| 62-28381 | 2/1987 | Japan | H01R 17/04 |

*Primary Examiner*—Neil Abrams
*Assistant Examiner*—Javaid Nasri

[57] ABSTRACT

The present invention provides an electrical connector and an electrical connector assembly in which good and uniform electrical connection can be obtained over a broad area even in cases where there is some positional deviation between the connectors at the time of mating engagement. The electrical connector 2 has an outer housing 50, a shield member 36 which is crimped onto an outer conductor 16 of a cable 10, an inner housing 70 and a male contact 30 which is disposed inside the inner housing 70 and crimped onto a center conductor. The male contact 30 has a cylindrical contact section 82 having a plurality of arms 88, and an elastic member 90 is disposed inside the arms 88.

11 Claims, 5 Drawing Sheets

ELECTRICAL CONNECTOR HAVING CONTACT ARMS BIASED BY AN ELASTIC MEMBER

FIELD OF THE INVENTION

The present invention relates to an electrical connector and an electrical connector assembly using the same. More specifically, the present invention relates to an electrical connector which is suitable for use in the supplying of electric power between automobile batteries, and an electrical connector assembly using the same.

BACKGROUND OF THE INVENTION

Electrical connector assembly 300 disclosed in Japanese Utility Model Application No. 62-28381 (shown in FIG. 6) is a conventional electrical connector in which a center conductor and an outer conductor used for ground are connected to each other. Electrical connector assembly 300 is constructed from a female connector 310, which has a cylindrical center female contact 312 and a cylindrical outer contact 314, and a male connector 350. The center pin contact 352 of the male connector 350 is engaged in the center female contact 312, and the cylindrical outer contact 354 of the male connector 350 is engaged with the inside of the outer contact 314, so that electrical connections are made therebetween.

In the connector described above, it is difficult to obtain a uniform contact pressure in cases where the center contacts 312, 352 are not properly aligned with each other in an axial direction. As a result, there is a danger that the reliability of the electrical connection will decrease. The reason for this is that although the center contact 312 is driven inward by a coil spring 316 mounted therein, engagement is made at few points, so that there is no effective compensation for misalignment.

SUMMARY OF THE INVENTION

The present invention was devised to overcome the drawbacks of the above conventional connector. An object of the present invention is to provide an electrical connector which can maintain a state of good electrical engagement over a broad area by compensation for some degree of misalignment between mating connectors, and an electrical connector assembly which uses the electrical connector.

The electrical connector of the present invention is equipped with a contact which has a substantially cylindrical contact section that is divided by slits extending in an axial direction from an outer end so that a plurality of arms are formed, and which is held in an insulating housing, and an elastic member, which is disposed so that the elastic member engages the contact section on the inside surfaces of the plurality of arms.

Furthermore, the electrical connector assembly using the electrical connector of the present invention comprises a first electrical connector which is equipped with a first contact which has a substantially cylindrical first contact section that is divided by slits extending in an axial direction from an outer end so that a plurality of arms are formed, and which is held in an insulating housing, and an elastic member which is disposed so that the elastic member engages the inside surfaces of the plurality of arms; and another electrical connector which is equipped with another contact provided with another substantially cylindrical contact section that engages an outer circumference of the first contact section at the time of engagement with the first electrical connector.

Furthermore, it is desirable that the outer contact used in the electrical connector of the present invention be covered by an insulating housing so that the outer contact is not exposed to the outside.

Moreover, it is desirable that the center contact and the outer contact have a waterproof structure so that these contacts are not short-circuited by condensation or moisture.

An electrical connector for mating engagement with a matable connector, comprises a dielectric housing; an electrical contact mounted in the housing and having a substantially cylindrical contact section in the form of cantilever contact arms; and an elastic member disposed within the cantilever contact arms.

An electrical connector assembly comprises a first electrical connector and a second electrical connector matable with the first electrical connector; a first dielectric housing having a first electrical contact mounted therein; a first contact section of the first electrical contact having cantilever contact arms; an elastic member disposed within the cantilever contact arms; a second dielectric housing having a second electrical contact mounted therein; and a second contact section of the second electrical contact electrically engagable with the cantilever contact arms with the elastic member acting to drive the cantilever contact arms outwardly thereby maintaining the cantilever contact arms in engagement with the second contact section.

BRIEF DESCRIPTION OF THE DRAWINGS

The invention will now be described by way of example with reference to the accompanying drawings in which.

DETAILED DESCRIPTION OF THE INVENTION

Figure 1:
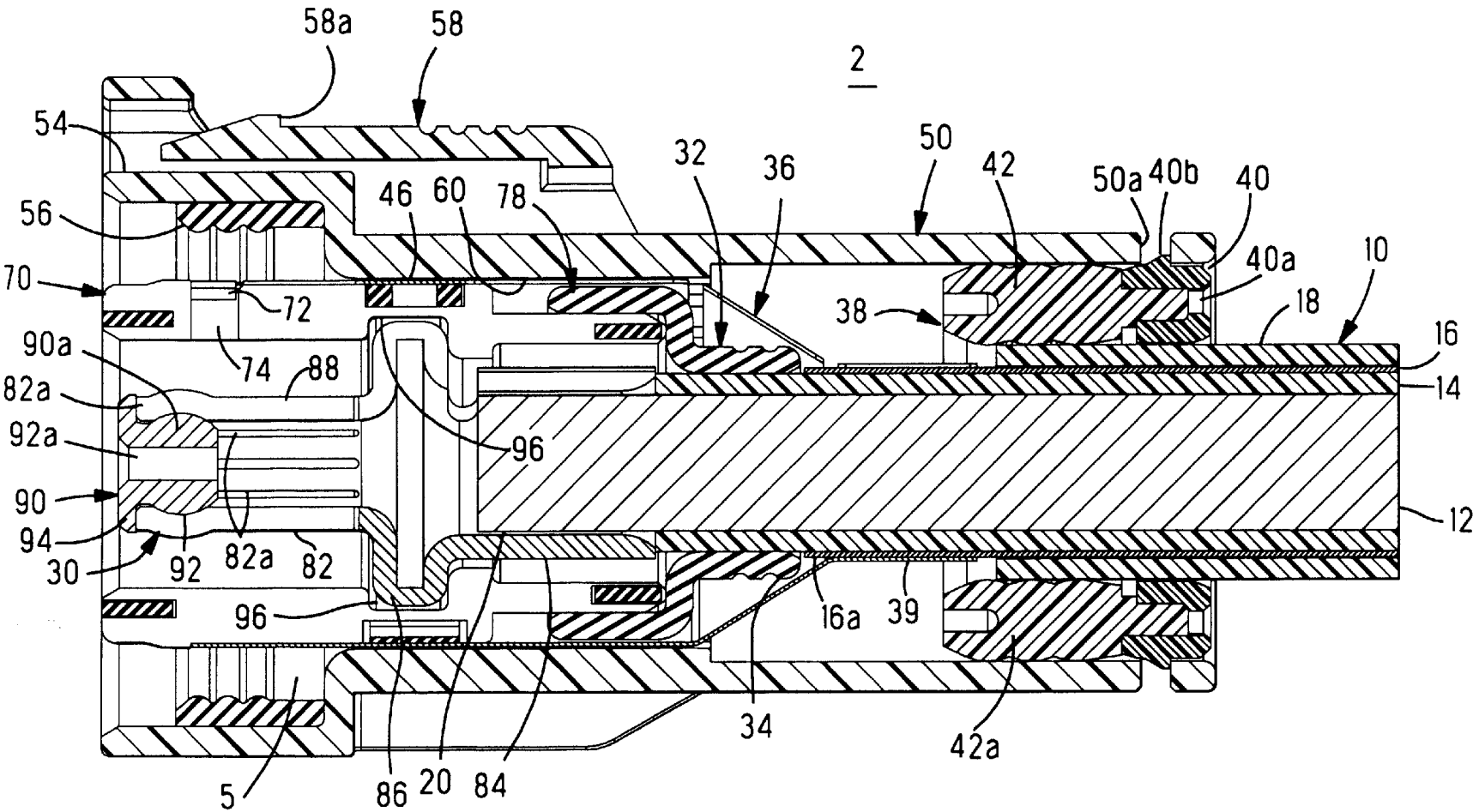
FIG. 1 is a cross-sectional view of an electrical connector of the present invention taken along line 1—1 in FIG. 2.

FIG. 1 is a cross-sectional view of an electrical connector of the present invention, i. e., of a male connector 2. A coaxial cable 10 includes a center conductor 12, an inner insulating member 14, an outer conductor 16 formed as a braided conductor, and an insulating outer covering 18 which covers the outer conductor. An end 20 of the center conductor 12 is exposed, and a male contact 30 is connected to the exposed end 20 by press-bonding or crimping thereto. A sealing member 32 used for waterproofing is fitted over an exposed front-end portion of the inner insulating member 14 and tightly fastened thereto. Braided outer conductor 16 is disposed on the outer circumference of the inner insulating body 14. The front exposed end 16*a* of the outer conductor 16 is positioned in the vicinity of the rear end 34 of the sealing member 32. In the vicinity of the front end 16*a* of the outer conductor 16, the outer covering 18 is stripped away so that the front end 16*a* of outer conductor 16 is exposed. A cylindrical rear section 39 of a shield member 36 is press-bonded or crimped onto front end 16*a* of exposed outer conductor 16. A sealing member 38 is constructed from a plastic ring 40 and an annular sealing member 42 which is formed as an integral part of the ring 40 by insert molding. A plurality of through-holes 40*a* are formed in the ring 40, and portions of a rear part of the sealing member 42 extend into these holes to form an integral unit. The sealing member 42 is in sealing engagement with the outer circumference of the outer covering 18.

Figure 3:
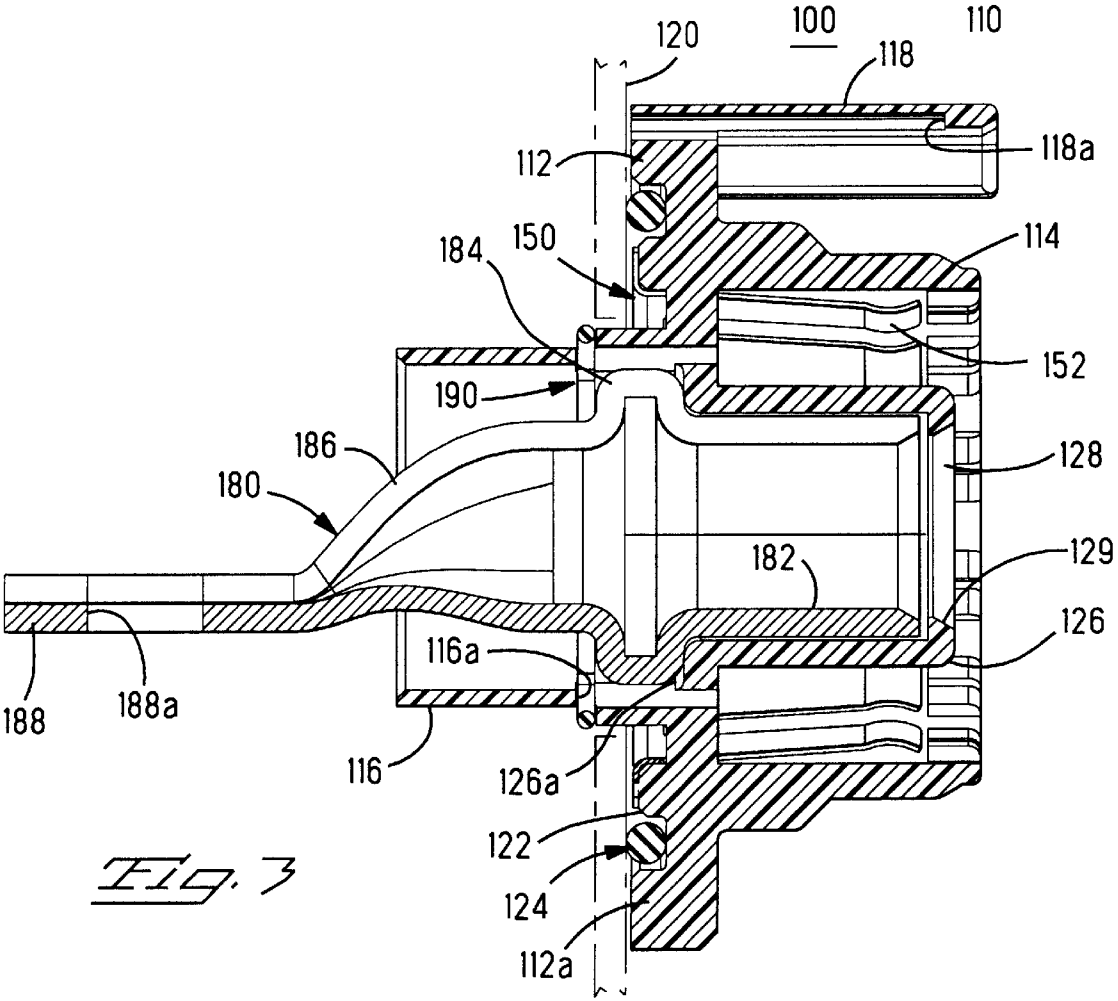
FIG. 3 is a cross-sectional view of a female connector taken along line 3—3 in FIG. 4.

A substantially cylindrical outer housing 50 fits over the respective outer circumferences of the sealing member 38 and a front cylindrical section 46 of the shield member 36. Holes 50*a*, which engage with latching projections 40*b* on the ring 40, are formed in a rear portion of the outer housing 50. A front portion of the outer housing 50 forms a large diameter hood section 54. A sealing member 56, which provides waterproofing between the hood section 54 and another electrical connector 100 which will be described later (see FIG. 3), is formed on the inside of the hood section 54 as an integral part of the hood section 54 by insert molding. Furthermore, a latching arm 58 which is used for engagement with the other connector 100 is formed on the outer housing 50. The front cylindrical section 46 of the shield member 36 engages an inside surface of the outer housing 50.

A substantially cylindrical inner housing 70 is disposed on the inside of the shield member 36. A rib 72 is formed on the end of the shield member 36, and rib 72 is disposed in a recess 74 formed in the inner housing 70, so that relative movement between the shield member 36 and inner housing 70 is prevented. Other means used to fasten the shield member 36 and inner housing 70 will be described later.

A large diameter front portion 78 of the sealing member 32 is positioned onto a rear portion of the inner housing 70 in a state of tight engagement therewith, so that waterproofing is provided between the outer conductor 16 and the male contact 30. As a result, the problem of short-circuiting between the outer conductor 16 and the male contact 30 via moisture in cases where condensation occurs can be avoided.

The male contact 30 has a contact section 82 which mates with a mating female contact 180 that will be described later (FIG. 3), a connection section 84, which is press-bonded or crimped to the center conductor 12, and an intermediate section 86 in the form of an annular bulge, which is located between the contact section 82 and the connection section 84. These sections have an annular shape; the intermediate section 86 has a large diameter, and forms the base portion of the contact section 82. A plurality of slits 82*b* which extend in an axial direction of the contact section 82 from the front end 82*a* are formed in the contact section 82. As a result, a plurality of cantilever contact arms 88 are formed. The portion of each arm 88 located in the vicinity of the front end 82*a* is bent outward; these portions form contact points which make contact with the mating contact.

Furthermore, an elastic member 90 in the form of silicone rubber or the like, is mounted in the front end portions of the respective arms 88. The elastic member 90 has an insertion section 92 with an outer surface 90*a* whose shape is substantially complementary to that of the inside surface of the contact section 82, and a front section 94, which engages the front ends 82*a* of the contact section 82 and substantially covers the front ends of cantilever arms 88. The front end portions of cantilever arms 88 are arcuate-shaped within which an annular arcuate-shaped portion 92*a* of insertion portion 92 is disposed. Furthermore, a through-hole 92*a*, which extends in an axial direction of the male contact 30 is formed in the insertion section 92. Elastic member 90 acts to drive the arms 88 elastically outward when the arms 88 are bent inward by the mating contact 180. As a result, contact pressure, which is sufficient for electrical contact can be applied to the arms 88 even if the contact 30 is formed from a material such as copper which does not have much elasticity. The intermediate section 86 of the male contact 30 is inserted into an annular recess 96 formed in the inside surface of the inner housing 70, so that the position of the male contact 30 is fixed within housing 70.

Figure 2:
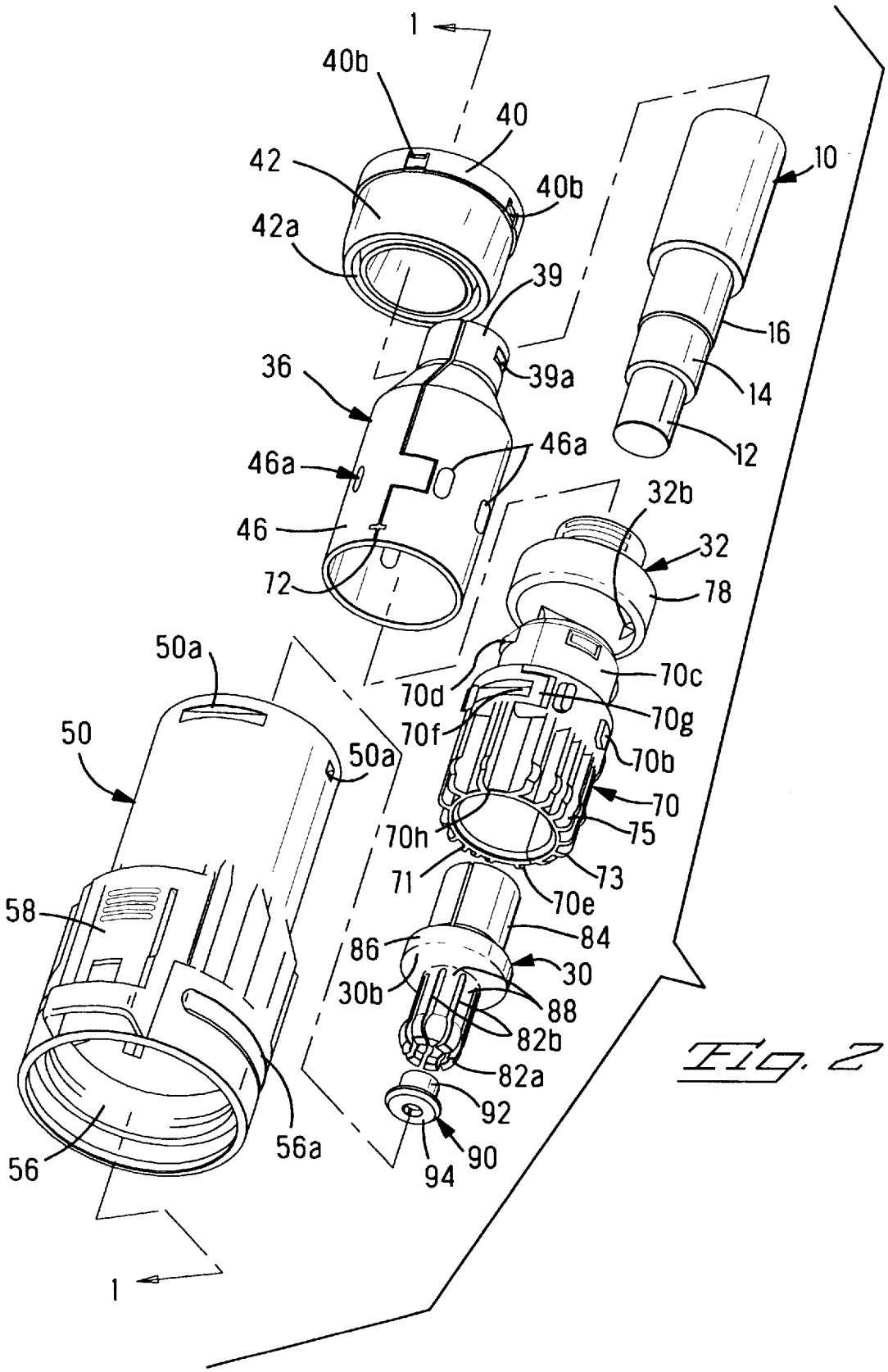
FIG. 2 is an exploded perspective view of the electrical connector shown in FIG. 1.

FIG. 2 shows an exploded perspective view of the electrical connector 2 shown in FIG. 1. An annular groove 42*a* formed in the front end of the sealing member 38 is used in order to facilitate insertion by flexing of the inside surface of the annular sealing member 42 when the sealing member 38 is engaged with the cable 10 from the rear. The shield member 36 is formed by stamping and forming a single metal sheet; here, inward-facing barbs are formed in openings 39*a* formed in the retaining section 39, and these barbs bite into the braided conductor 16 when the shield member 36 is press-bonded onto the outer conductor 16, so that a secure electrical connection is established. Furthermore, substantially oval holes 46*a* are formed in the outer cylindrical section 46. Holes 46*a* engage with projections 70*b* formed with a complementary shape on the outer surface of the inner housing 70 when the inner housing 70 is accommodated within shield member 36, so that mutual positioning thereof is accomplished. The rib 72 mentioned above can be seen at the front end of the shield member 36. Rib 72 is disposed in the recess 74 formed in the joint seam 70*h*, as was described above.

Long, slender recessed grooves 32*b* are formed in the inside surface of the front portion 78 of the sealing member 32; when the sealing member 32 is fitted over a rear portion of the inner housing 70, these recessed grooves 32*b* engage with projections 70*d* which have a complementary shape formed on the outer circumferential surface 70*c* of the rear portion of the inner housing 70, so that relative movement therebetween is prevented. The inner housing 70 has an integral plastic structure which is connected by pins 70*e*, and is constructed from substantially semi-cylindrical half bodies 71 and 73. The respective half bodies 71 and 73 are joined at seams 70*h*, and are fastened to each other by latching projections 70*f* formed on the half body 73 and latching arms 70*g* formed on the half body 71. A plurality of ribs 75 are formed on the inner housing 70; these ribs 75 are used for the dissipation of heat and the prevention of shrinkage following molding.

The male contact 30 is obtained by the bending of a single metal plate; 30*b* indicates the joint seam of the male contact 30. As seen from FIG. 1, the front portion 94 of the elastic member 90 covers the tip end 82*a* of the contact 30; accordingly, even if a finger is inserted from the front, direct contact with the tip end 82*a* is prevented, so that electric shock is prevented.

Holes 50*a* are located in the rear portion of the outer housing 50; holes 50*a* engage with latching projections 40*b* formed on the sealing member 38 as described above, so that the sealing member 38 is latchably fastened to the outer housing 50. The part indicated by 56*a* on the outer circumference of the front portion of portion of the outer housing 50 is a portion of the sealing member 56; this portion 56*a* communicates with the inside sealing member 56 via a through-hole (not shown) formed in the outer housing 50. Accordingly, there is no danger that the sealing member 56 will be peeled from the outer housing 50.

Next, the female connector 100, which is mated with the male connector 2, will be described with reference to FIG.

3. The female connector 100 has an insulating housing 110, a ground contact 150 which is disposed inside the insulating housing 110, and a female contact 180. A substantially rectangular plate-form base 112 and a substantially cylindrical insertion section 114, which extends forward from base 112, are formed as part of the insulating housing 110. An annular extension 116, which extends rearward and protects the female contact 180, is formed on the base 112. Furthermore, a latching member 118, which extends forward and engages with the latching arm 58 of the male connector 2, is formed on the edge of one end of the base 112. A latching surface 118*a*, which engages with latching projection 58*a* on the latching arm 58, is formed in the vicinity of the front portion of the latching member 118.

An annular groove 122 is formed in a back surface 112*a* of the base 112, and rubber gasket 124 is disposed in groove 122. When the female connector 100 is attached to panel 120 of a battery case, rubber gasket 124 provides sealing, i. e., waterproofing, between the battery case and the outside. The insertion section 114 is inserted into the interior of the male connector 2 when the female connector 100 is mated with the male connector 2. The ground contact 150 has numerous cantilever contact arms 152 which are disposed along an interior circumference of the insertion section 114. Furthermore, a cylindrical section 126, which is concentric with the insertion section 114, is formed as an integral part of the insertion section 114 inside the insertion section 114. A circular opening 128, which has a beveled surface 129, is formed in the front surface of the cylindrical section 126, and the female contact 180 is disposed inside the cylindrical section 126.

The female contact 180 has a cylindrical contact section 182, an annular bulge 184, which is positioned on the rear portion of contact section 182, and a connection section 188, which extends to the rear of the bulge 184 via a transition section 186. A hole 188*a*, which is connected with a cable conductor via a ring terminal (not shown) by means of a bolt, is formed in the connection section 188. A separate locking member 190, which is formed from a wire, is disposed to the rear of the bulge 184. Locking member 190 has spring characteristics, and can flex inward in a direction perpendicular to an axial direction of the female contact 180. When locking member 190 is positioned in a slot or cut-out 116*a* formed in the extension 116, and is then caused to undergo recovery, the bulge 184 engages a rear shoulder 126*a* of the cylindrical section 126, and is clamped between rear shoulder 126*a* and the locking member 190.

Figure 4:
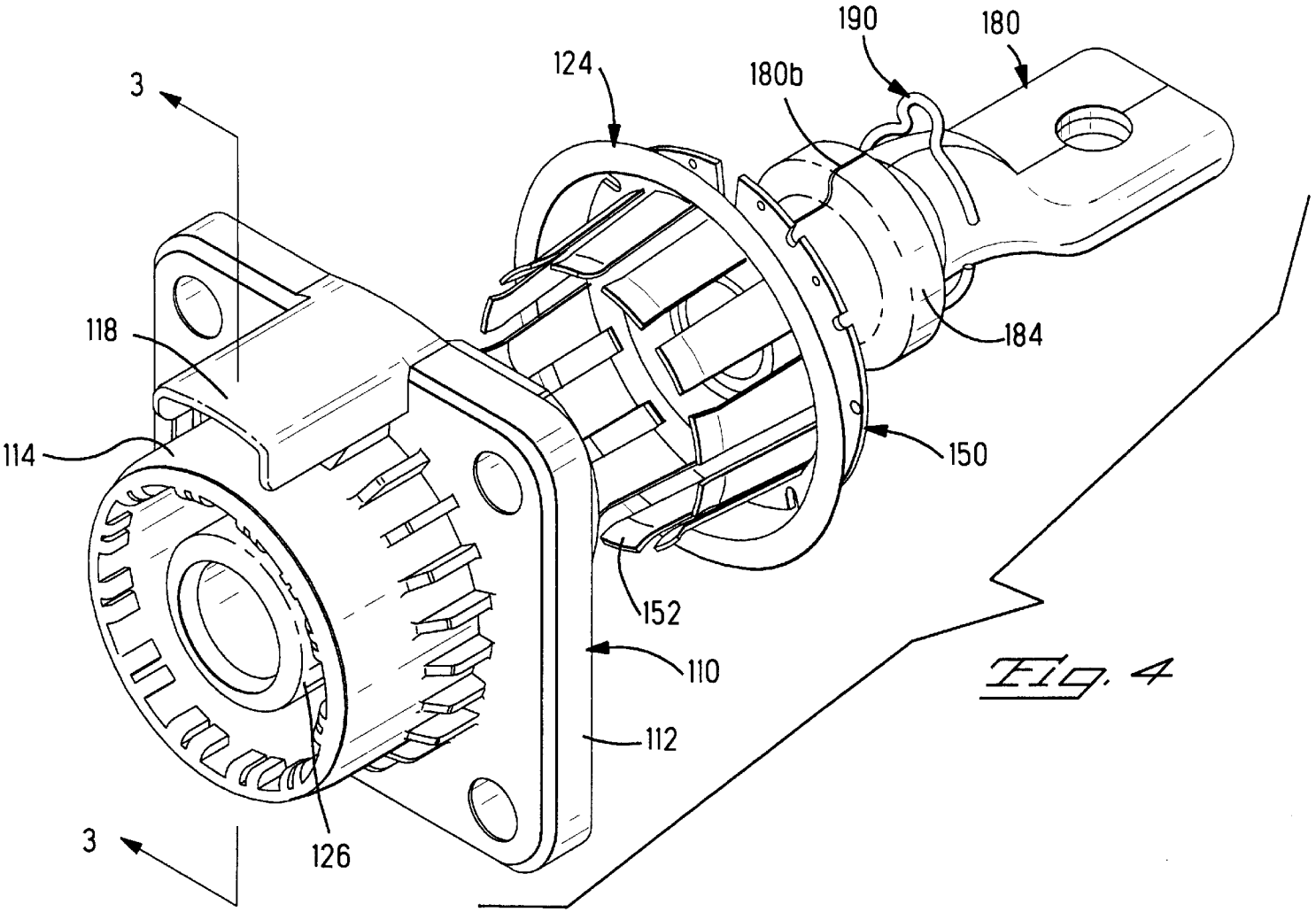
FIG. 4 is an exploded perspective view of the female connector shown in FIG. 3.

Next, the female connector 100 will be described with reference to the exploded perspective view shown in FIG. 4. The ground contact 150 is formed into an integral unit by stamping and forming a single metal sheet, and is press-fit into insertion section 114. The circumferential disposition of the contact arms 152 is easily seen. The female contact 180 is stamped out from a metal sheet, and is formed so that the respective portions of the contact meet at the joint 180*b*.

Figure 5:
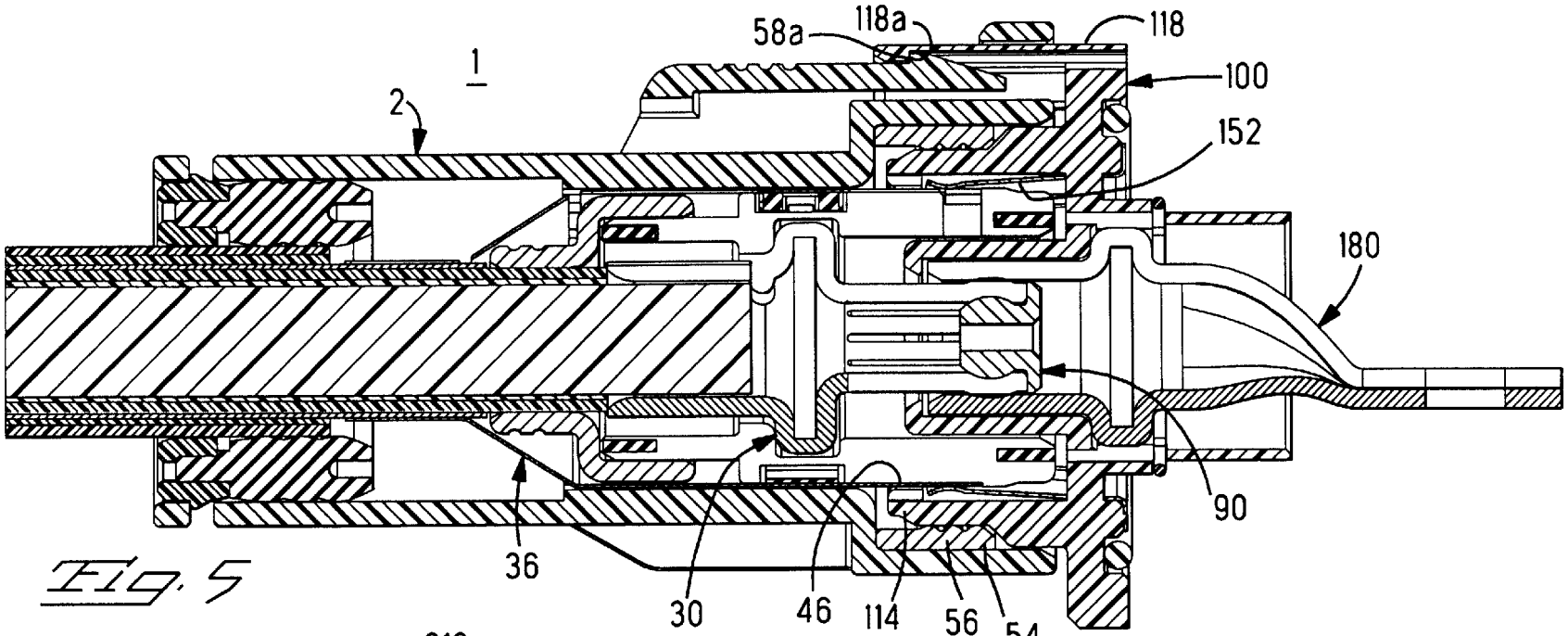
FIG. 5 is a cross-sectional view of an electrical connector assembly of the present invention, in which the connectors shown in FIGS. 1 and 3 are electrically engaged.
Figure 6:
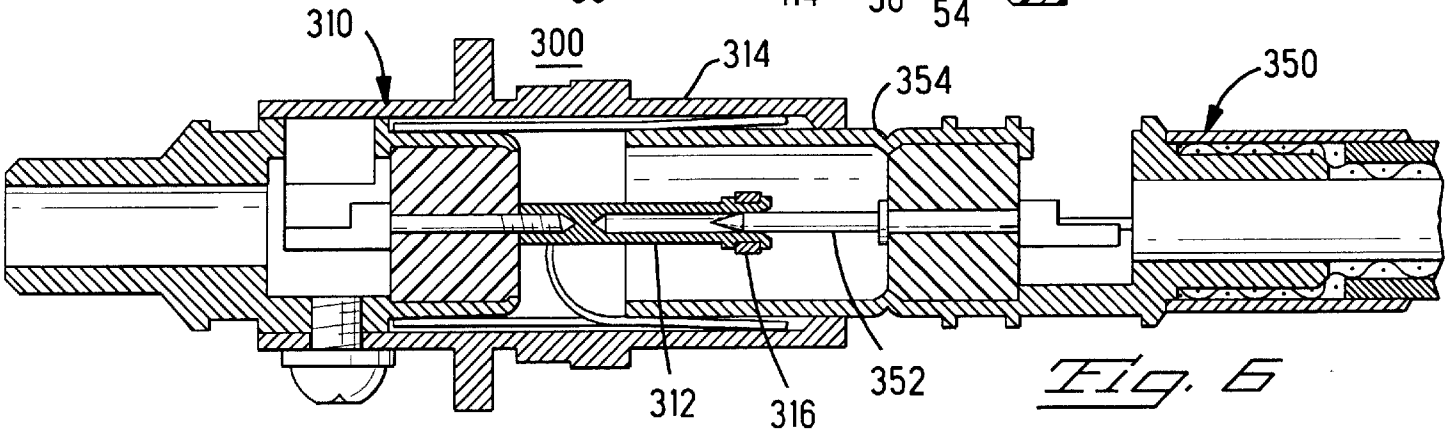
FIG. 6 is a cross-sectional view showing a conventional electrical connector assembly.

Next, FIG. 5 shows a cross-sectional view of the electrical connector assembly 1, in which the male connector 2 and female connector 100 are completely electrically engaged. In this state, the female contact 180 accommodates the male contact 30 so that an electrical connection is established therebetween. Referring again to FIG. 1 as well, it is seen that the latching surface 118*a* of the latching member 118 engages with the latching projection 58*a* of the latching arm 58, and that the insertion section 114 is inserted into an annular recess 5 of the male connector 2. Sealing member 56 is located between the hood section 54 and the insertion section 114, and thus provides waterproofing therebetween.

In cases where the centers of the male contact 30 and female contact 180 are slightly misaligned at the time of engagement, the arms 88 on the strongly pressed side will be displaced inward. However, this displacement will act on the arms 88 on the opposite side via the elastic member 90, and will also be dispersed to the other surrounding arms 88, so that these other arms 88 are driven outward. As a result, a relatively uniform contact pressure is maintained so that a good electrical connection is established. Furthermore, since there are numerous points of contact, this arrangement is suitable for use in the case of a large electrical current.

An embodiment of the present invention has been described in detail above. However, the present invention is not limited thereto; various modifications and alterations are possible. For example, a through-hole 92*a* is formed in the elastic member 90; it would also be possible to provide the female contact 180 with a member which is passed through through-hole 92*a*, and to use this member as a guide at the time of mating engagement.

The electrical connector of the present invention is equipped with an electrical contact which has a substantially cylindrical contact section which includes a plurality of cantilever arms, and an elastic member which is disposed inside the arms. Furthermore, the electrical connector assembly of the present invention has an electrical contact which is equipped with another substantially cylindrical contact section that engages an outer circumference of the cantilever arms. Accordingly, the present invention has the following merit: specifically, an electrical connector and electrical connector assembly are provided in which misalignment of the connectors is absorbed by the contacts, so that a broad contact range with a relatively uniform contact pressure is obtained.

I claim:

1. An electrical connector for mating engagement with a matable electrical connector, comprising a dielectric housing;

an electrical contact disposed in the dielectric housing and having a connection section for electrical connection to an electrical conductor of an electrical cable, a substantially cylindrical contact section in the form of cantilever contact arms, and an annular bulge disposed between the cylindrical contact section and the connection section; the annular bulge being disposed in an annular recess within the dielectric housing thereby fixing the electrical contact within the dielectric housing; and an elastic member disposed within the cantilever contact arms, and substantially covering front ends of the cantilever contact arms.

2. An electrical connector as claimed in claim 1, wherein said dielectric housing is an inner housing disposed within an outer dielectric housing.

3. An electrical connector as claimed in claim 2, wherein a shield member has a front portion disposed between the outer dielectric housing and the inner housing and a rear portion for connection to an outer conductor of the electrical cable.

4. An electrical connector as claimed in claim 3, wherein a sealing member is disposed between an inner surface of said shield member and an inner insulating member of the electrical cable.

5. An electrical connector as claimed in claim 1, wherein front ends of said cantilever contact arms are arcuate shaped within which an annular arcuate-shaped portion of said elastic member is disposed.

6. An electrical connector assembly comprising a first electrical connector and a second electrical connector matable with the first electrical connector;

a first dielectric housing having a first electrical contact disposed therein, the first electrical contact having a first contact section in the form of cantilever contact arms, a first connection section for electrical connection to an electrical conductor of an electrical cable, and an annular bulge disposed between the first contact section and the first connection section, the annular bulge being disposed in an annular recess within the first dielectric housing thereby fixing the first electrical contact within the first dielectric housing;

an elastic member disposed within the cantilever contact arms and substantially covering front ends of the cantilever contact arms;

a second dielectric housing having a second electrical contact mounted therein; and a second contact section of the second electrical contact electrically engagable with the cantilever contact arms with the elastic member acting to drive the cantilever contact arms outwardly thereby maintaining the cantilever contact arms in electrical engagement with the second contact section.

7. An electrical connector assembly as claimed in claim 6, wherein a shield member has a front section extending along said first dielectric housing and a rear section for electrical connection to an outer conductor of an electrical cable.

8. An electrical connector assembly as claimed in claim 7, wherein an outer dielectric housing extends along said first dielectric housing with said front section of said shield member disposed therebetween.

9. An electrical connector assembly as claimed in claim 8, wherein said outer dielectric housing and said second dielectric housing have latching members for latching the first electrical connector to the second electrical connector.

10. An electrical connector assembly as claimed in claim 6, wherein front ends of said cantilever contact arms are arcuate shaped within which an annular arcuate-shaped portion of said elastic member is disposed.

11. An electrical connector assembly as claimed in claim 7, wherein a ground electrical contact is mounted onto said second dielectric housing concentric with said second electrical contact, said ground electrical contact includes cantilever arm members for electrical engagement with said front section of said shield member when the first electrical connector is mated to said second electrical connector.

* * * * *